US005532793A

United States Patent [19]

Kogure

[11] Patent Number: 5,532,793

[45] Date of Patent: Jul. 2, 1996

[54] PAPER TRANSPORT APPARATUS CAPABLE OF REMOVING LESS JAMMED PAPER IN IMAGE FORMING APPARATUS

[75] Inventor: Yoshio Kogure, Kanagawa, Japan

[73] Assignee: Fuji Xerox Co., Ltd., Tokyo, Japan

[21] Appl. No.: 325,933

[22] Filed: Oct. 19, 1994

[30] Foreign Application Priority Data

Oct. 21, 1993 [JP] Japan ..... 5-285628

[51] Int. Cl.[6] ..... G03G 21/00; G03G 15/00

[52] U.S. Cl. ..... 355/207; 355/208; 355/309; 355/318; 355/319; 355/321; 271/256; 271/301; 271/184

[58] Field of Search ..... 355/205, 207, 355/208, 308, 309, 316, 318, 319, 321, 24; 271/301, 256, 184, 259, 258.01–258.05

[56] References Cited

U.S. PATENT DOCUMENTS

| | | | |
|---|---|---|---|
| 4,231,567 | 11/1980 | Ziehm | 271/259 |
| 4,627,711 | 12/1986 | Schron | 355/208 |
| 4,816,872 | 3/1989 | Okamoto et al. | 355/24 X |
| 5,233,401 | 8/1993 | Sasaki et al. | 355/319 |
| 5,257,070 | 10/1993 | Miller et al. | 355/207 |
| 5,258,818 | 11/1993 | Sundquist et al. | 355/319 X |
| 5,328,168 | 7/1994 | Fox | 271/259 |
| 5,337,135 | 8/1994 | Malachowski et al. | 355/319 |
| 5,381,220 | 1/1995 | Acquaviva et al. | 355/316 X |

FOREIGN PATENT DOCUMENTS

| | | |
|---|---|---|
| 2-239058 | 9/1990 | Japan . |
| 2-257158 | 10/1990 | Japan . |

*Primary Examiner*—Matthew S. Smith
*Attorney, Agent, or Firm*—Finnegan, Henderson, Farabow, Garrett & Dunner

[57] ABSTRACT

An image forming apparatus includes a paper transport apparatus having a paper supply path, a paper supply tray, and an invert-transport path for alternately transporting blank copy paper sheets and single-face copy paper sheets. The invert-transport path includes an inversion path, a double-face-copy invertor apparatus, and a double-face-copy transport path member. The invert-transport path is connected via the double-face-copy transport path member to the paper supply path, and the paper supply tray is coupled to the double-face-copy transport path member. The single-face copy paper sheets are fed from the paper supply tray via the double-face-copy transport path member to the paper supply path. The paper transport apparatus further includes a control unit for performing a first operation and a second operation. The first operation is carried out in such a manner that, when a paper jam occurs in the invert-transport path, a first single-face copy paper sheet located at an image transfer unit of the image forming apparatus is formed as a double face copy paper sheet and then is directly ejected to an ejection tray. The second operation is carried out in such a manner that a second single-face copy paper sheet is sequentially advanced to a waiting position located on an up stream side of the paper jam.

8 Claims, 6 Drawing Sheets

PAPER TRANSPORT APPARATUS CAPABLE OF REMOVING LESS JAMMED PAPER IN IMAGE FORMING APPARATUS

BACKGROUND OF THE INVENTION

The present invention generally relates to a paper transport apparatus employed in an image forming apparatus such as an electrophotographic, or xerographic copying machine capable of forming a double-face (duplex) copy. More specifically, the present invention is directed to a paper transport apparatus equipped with such a paper processing means so that when a paper jam occurs in a paper transport path, copy paper, which is ejectable as a double-face copy, is transported toward an ejection tray. Thus, the amount of jammed copy paper removed from the paper transport path is reduced as much as possible.

In an image forming apparatus such as an electrophotographic copying machine and a laser beam printer, there is typically provided an apparatus for forming an image on one surface of the paper to provide a single-face copy, and another apparatus for forming images on both surfaces (front/rear faces) of the paper to provide a double-face copy. In the automatic double-face copying machine, as disclosed in Japanese Laid-open Patent Application No. 2-239058 (opened in 1990), the copying machine is constructed so that copy paper formed as a single-face copy is inverted to transfer an image on a rear surface of the paper, thereby forming a double-face copy. The inverting transport path is provided in the automatic double-face copying machine so that one image may be transferred to the front face (first face) of the copy paper stored in the paper supply unit in order to obtain the single-face copy paper, and so that the single-face copy paper may be inverted to transfer another image to the rear face (second face) in order to obtain the double-face copy paper. Both the operation of transferring the image to the first face of the paper fed from the paper supply tray, and the operation of transferring the image to the second face of this single-face copy paper are alternately repeated.

When a so-called "paper jam" occurs in the paper transport path and the copy paper [hereinafter referred to as "jammed paper"] is stopped within the paper transport path in the automatic double-face copying machine, all operations of the copying machine are interrupted so that the copying machine can issue a demand for removal of the jammed paper to the control panel. However, if the copy paper remains within the image fixing apparatus when the jammed paper is stopped in the paper transport path, then a problem is produced. Furthermore, since most double-face copying machines include a control system which requests the commencement of a newly formed single-face copy when all of the copy paper left in the paper transport path is removed after a paper jam occurs, a heavy burden is placed on the operator and a large amount of copy paper is wasted.

To solve these problems, the conventional copying machine, as described in Japanese Laid-open Patent Application No. 2-239058, is stopped when the image writing error occurs, and the operation mode is switched from the inverting path to the ejecting path in order to process the copy paper. As described in Japanese Laid-open Patent Application No. 2-257158, when the paper jam occurs in the invert-transport path, the copy paper remaining in the paper transport path is automatically removed from the paper ejecting port located in front of the paper transport path. With the employment of the above-described automatic paper ejecting method, only the jammed paper is removed from the paper transport path, so that the paper jamming problem can be solved and the copying machine can be easily restarted.

As explained in connection with the prior art, in the relatively compact image forming apparatus, the amount of copy paper transported through the paper transport path is small, and the amount of jammed copy paper wasted during the paper jam processing operation is also small. Further, the amount of reformed copy paper is small. For example, in the copying machine disclosed in Japanese Laid-open Patent Application No. 2-239058, when a printing error occurs, only one sheet of copy paper is wasted and the subsequent printing operation can be readily recovered. In contrast, as explained in Japanese Laid-open Patent Application No. 2-257158, when paper jamming occurs in the invert-transport path, a means for ejecting the single-face copy paper and a means for directly ejecting paper upon which no image has been transferred are employed. However, the transport means for storing the single-face copy paper must be provided separately from the main body of the copying machine. Another problem is that the construction of the paper transport apparatus is complex. A further problem is that the single-face copy paper stored in the ejection tray provided in the copy machine is discarded, and therefore a heavy burden is placed on the operator since a new copy must be formed to replace the discarded single-face copy paper sheets.

In a relatively large-scale, automatic, double-face copying machine, 5 to 6 sheets (i.e., large numbers) of copy paper are transported within the paper transport path. When paper jamming occurs in the paper transport path, a large number of sheets of copy paper needs to be removed. After the jammed paper has been removed from the paper transport path, a new copy is required to be generated, so that a heavy burden is placed on the operator. In the worst case, there is the potential that all of the copies would have to be regenerated. Also, when the copy paper, whose first plane has been copied, is jammed in the transport path, very cumbersome processing operations are required to remove the jammed paper and the copy paper preceding and succeeding the jammed paper.

For instance, before the double-face copy paper is to be ejected, the single-face copy paper may be exhausted to the purge tray. However, there are two different methods to accomplish this. The single-face copy paper located up stream from the jammed paper is stopped at its present position, or a copy paper ejecting means is provided. However, there is the problem that when the transportation of the single-face copy paper up stream from the jammed paper is stopped, both the jammed paper and the copy paper located up stream are removed from the paper transport path, resulting in a large amount of wasted copy paper. A further problem is that since the copy paper is rejected by using the purge tray, these copies are ejected under such a condition that the single-face copy paper is mixed with the double-face copy paper, placing a very heavy burden on the operator so as to process the subsequent copy paper.

In addition to the above-described problems, a paper invert-ejecting mechanism having a copy ejecting unit is provided for the automatic double-face copying machine so as to constitute a multifunctional copying machine. However, when the copy invert-ejecting mechanism is arranged with an inverting path and a paper jam occurs, all of the copy paper present up stream from the paper jam are stopped. Thus, the paper located in the image fixing apparatus could be burned by heat of the heat roller. To avoid such a problem, it is possible for the paper located within the image fixing apparatus to be forcibly transported along the copy ejecting direction, whereby the adverse influences of the heat roller may be eliminated, and the cumbersome operation of removing the remaining paper from the image fixing apparatus may be omitted. However, it is difficult to employ such a method since the copy paper forcibly fed out will collide with the copy paper stopped at the ejecting unit, and thus worsen the jamming condition. Also, since the paper transport intervals within the paper transport path are separated from each other in the conventional automatic double-face copying machine, it is not possible for the subsequent copy paper to be injected into the image fixing apparatus while a single sheet of copy paper is located in the inverting path.

SUMMARY OF THE INVENTION

An object of the present invention is to provide an automatic double-face copying machine capable which can easily process a plurality of jammed copy paper sheets in the paper transport path of the copying machine. Another object of the present invention is to provide an automatic double-face copying machine capable of readily recovering a forming copy by performing a process operation when a paper jam occurs, whereby the copy paper sheet under double-face duplication continues to be copied, the double-face-duplicated copy paper sheet is ejected, the single-face copy paper sheet is fed up stream from the paper jam, and only the jammed copy paper sheet is removed.

To achieve the above-described objects, an image forming apparatus according to one aspect of the present invention is provided having a mechanism capable of forming an image on both first and second faces of copy paper sheets; the image is transferred to the first face to thereby form a single-face copy paper sheet; the single-face copy paper sheet being supplied from a paper supply tray to a paper supply path and via a transport path member for double-face copy paper sheet; and while both the paper sheet having a first face to which the image is to be transferred, and the paper sheet having a first face to which the image has been transferred and having a second face to which the image will be formed, are alternately transported, and the image transfer operation is carried out. In accordance with the present invention, the path for transporting single-face copy paper sheets in correspondence with the second face is constituted by an inverting path, a double-face invertor apparatus, and a transport path member for double-face copy paper sheets. The invert-transport path is connected via the above-described transport member so that double-face copy paper sheets may enter the paper supply path. Also, a control means is included which executes an operation such that when the paper jam occurs in the invert-transport path, a copy paper sheet with a single-face copy and which is located at the image transfer unit is directly ejected as a double-face copy paper sheet to the ejection tray, and a plurality of copy paper sheets whose first faces have been image-copied are sequentially advanced by one step up to the waiting position located up stream from the jammed paper.

Further, in accordance with the present invention, an invert-ejecting means is arranged in correspondence with the copy ejecting unit of the paper transport path. In the case of a single-face copying operation, an invert-ejection mode and a direct ejection mode are selectably set. In the case of a normal double-face copying operation, a direct ejection mode is set. Furthermore, in accordance with the present invention, in the double-face invertor apparatus and the inversion path, which constitute the invert-transport path, the apparatus may be arranged so that only one sheet of paper can be stored under normal conditions, and a plurality of paper sheets may be temporarily stored when a paper jam occurs. In addition to the above-described arrangements, according to another aspect of the present invention, the inversion path may be arranged between the image fixing apparatus and the ejecting unit via a transport path switching member. When a paper jam occurs down stream from the transport path switching member of the ejection path, a means may be arranged which transports the succeeding paper sheet directly to the inversion path. Furthermore, it is possible to include a control means such that when a paper jam occurs in the path used to transport the paper sheet from the inversion path to the ejection path, the subsequent paper sheet is inserted into the inversion path, a nip of a transport roller apparatus arranged inside the inversion path is temporality released, and the paper sheets are stored within the inversion path under the condition that portions of the two sheets of paper are overlapped with each other.

In accordance with the image forming apparatus of the present invention, when double-face copying is produced under the condition that large amounts of paper sheets are transported in the paper transport path, even if a paper jam occurs in the invert-transport path, the single-face copy paper sheets may be sequentially transported up stream from the place where the paper jam occurs, and may be stopped there. Since the paper sheet, which can be ejected as a double-face copy, is ejected toward the ejection tray under a copy completion condition, the copy forming operation can be restarted by removing only the jammed paper sheet, whereby the burden placed on the operator can be reduced. When the paper jam occurs in the paper invert-ejecting path, a mechanism is constructed which feeds the paper sheet located in the image fixing apparatus toward the inversion path. Consequentially, the subsequent paper sheet will not collide with the jammed paper sheet, and thus prevents an occurrence of such an inconvenient condition. That is, the paper sheet is stopped at the position of the image fixing apparatus.

BRIEF DESCRIPTION OF THE DRAWINGS

For a better understanding of the present invention, reference is made to the following detailed description in conjunction with the accompanying drawings, in which.

DETAILED DESCRIPTION OF THE PREFERRED EMBODIMENTS

A description will now be made of a paper transport apparatus of an image forming apparatus according to the present invention with reference to illustrative examples.

Figure 1A:
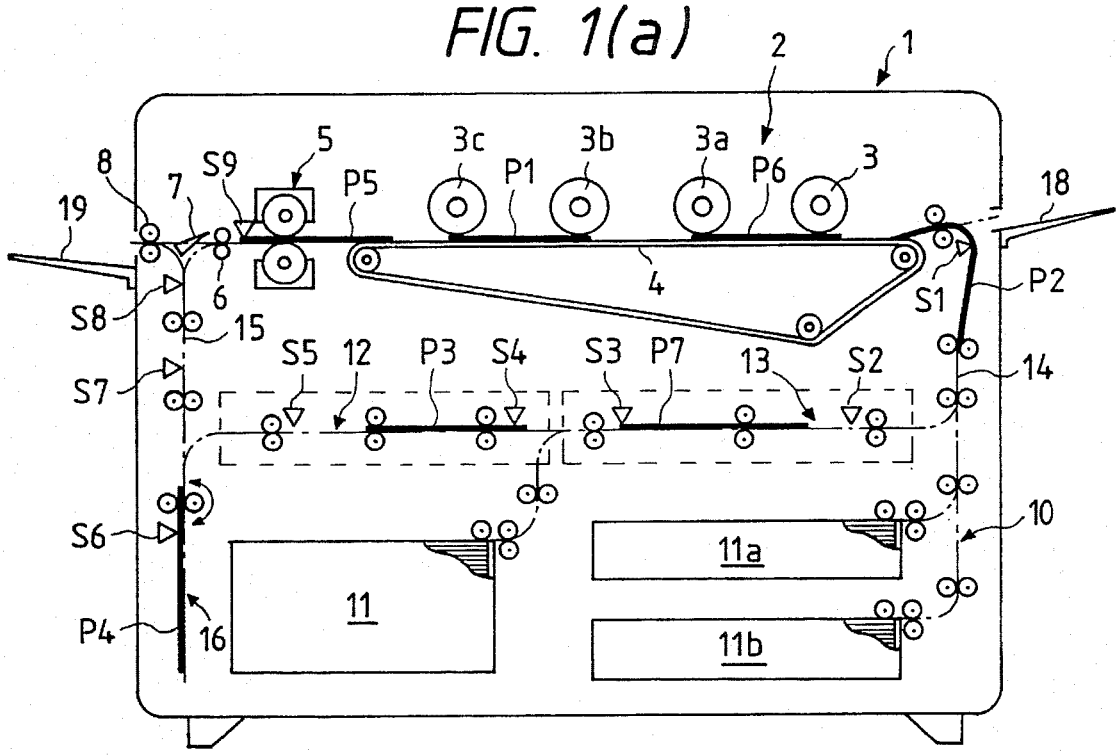
FIGS. 1(*a*) and 1(*b*) schematically illustrate an electrophotographic copying machine to which the present invention can be applied.
Figure 1B:
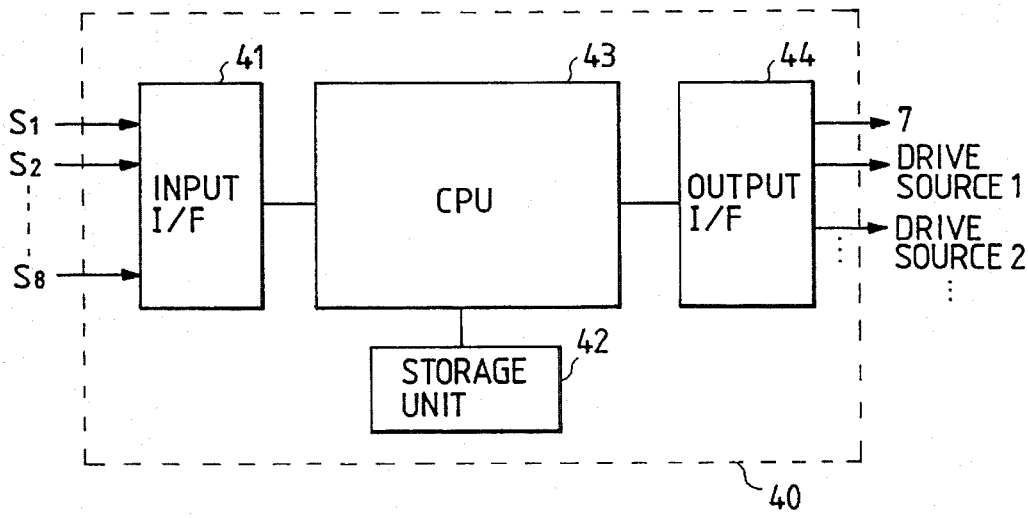

In FIG. 1, there is schematically shown an arrangement of an image forming apparatus 1, according to the present invention, which is an automatic double-face copying machine. In this example, four photosensitive drums 3, 3*a*, 3*b*, and 3*c* are arranged in an image transfer unit 2 of the image forming apparatus 1 to constitute a full-color copying machine. The photosensitive drums 3, 3*a*, 3*b*, 3*c* are arranged in the image transfer unit 2 and are used as a writing means for forming different color images. A toner image forming mechanism is arranged in the image forming apparatus 1. Image information is transferred from an image information output apparatus, such as a computer, and the image information is resolved into image information components for every color. A color toner image is formed on each of the photosensitive drums, and thereafter the color toner images are transferred to the paper. In the image transfer unit 2, a transport belt 4 for transporting paper sheets is equipped with a means for holding the paper sheets on the belt surface by electrostatic force, and is additionally equipped with a means for preventing positional shifts from being produced at the image transfer position by employing an arbitrary paper holding means, such that the color toner images are overlapped and transferred to the paper sheets.

In the image forming apparatus 1, a plurality of paper supply trays 11, 11*a*, 11*b* are arranged, and the paper sheets, whose sizes are designated, can be fed out from the relevant paper supply tray. The paper sheets fed out from the paper supply tray are transported through a paper supply path 14, and is delivered to the transport belt 4 of the image transfer unit under the condition that the paper sheets are registered by a register roller apparatus, thereby transferring the toner image to the delivered paper sheets. Thereafter, the paper sheets are treated in an image fixing apparatus 5, and the image-fixed paper sheets are ejected to an ejection tray 19 by way of a transport roller apparatus 6 and an ejection roller 8. Also, the image forming apparatus of the present invention is so constructed that it can selectively set an arbitrary ejection mode in which the copy paper sheets formed as a single-face copy sheets are ejected in an inversion condition through an inverting means provided in the ejection path, or otherwise may be directly ejected.

In the image forming apparatus, an invert-transport path used to form double-face copy sheets is so arranged that an inversion unit 15 and a double-face copy invertor apparatus 16 are provided via a switching gate apparatus 7 functioning as a transport path switching member arranged between the transport rollers 6 and 8. Further, a double-face-copy transport path member 12 is provided via a branch means between the inversion unit 15 and the double-face copy invertor apparatus 16. On the down stream side of the double-face-copy transport path member 12, a registration transport unit 13 is provided which also functions as a paper supply path from the paper supply tray 11, such that the registration transport unit 13 is connected to the paper supply path 14.

In the double-face (copy) invertor apparatus 16 employed in the invert-transport path, a roller apparatus is arranged through which the copy paper sheets can be transported with respect to the transport path along the normal and reverse directions. This double-face invertor apparatus 16 receives and stores the copy paper sheets fed from the inversion unit 15, and thereafter delivers the copy paper sheets to the double-face-copy transport path member 12. A guide means is provided with the double-face-copy transport path member 12 by which the paper sheets are guided from the connection portion between the inversion path 15 and the double-face invertor apparatus 16 through the switching gate apparatus. Accordingly, the single-face copy paper sheets may be fed in an inverted position. Furthermore, the registration transport unit 13 arranged between the double-face-copy transport path member 12 and the paper supply path 14 constitutes a paper supply path for the paper supply tray 11. In addition, the registration transport unit 13 registers a plurality of copy paper sheets in which a skew is produced while the paper sheets are transported within the invert-transport path. For instance, in the registration transport unit 13, the copy paper sheets are transported along a registration wall member of the paper path, whereby a registration effect is provided for the transported paper sheets, so that the paper sheets can be delivered to the paper supply path 14. Since the registration means is arranged inside the invert-transport path, it is possible to reduce the workload required when the registration effect is applied to the single-face copy paper sheets up stream from the image transfer unit.

Within the above-described paper transport path, both a paper sheet P1 in which an image is transferred to a second face thereof, and a paper sheet P6 in which an image is transferred to a first face thereof are positioned in the image transfer unit 2, whereas a paper sheet P2, corresponding to the image transfer of the second face, is located in the paper supply path 14. In the portion of the image fixing apparatus 5, a paper sheet P5, in which the image has been formed on the first face thereof, is under the image fixing condition; the single-face copy paper sheet P4 is positioned at the double-face invertor apparatus 16; the inverted single-face copy paper sheet P3 is located at the double-face-copy transport path member 12; and a copy paper sheet P7, newly fed from the paper supply tray 11, is located at the registration transport unit 13. Thus, the copy paper transport operation is carried out in such a manner that the interval between each successive copy paper sheet is reduced by employing a control method in which a plurality of copy paper sheets are successively fed from the up stream sections based upon the information received by the respective sensors S1 to S8. These paper sensing sensors are positioned in the respective paper transport sections and sense the copy paper sheets passing by them.

In the invert-transport path, the paper sheets fed out from the paper supply tray are interposed between the successive single-face copy paper sheets, whereas in the image transfer unit 2, the first-face-image transfer operation and the second-face-image operation are sequentially repeated. Thereafter, the copy paper sheets to which the second face image has been transferred are ejected through the image fixing apparatus to the ejection (delivery) tray 19, whereas the copy paper sheets, to which the first face image has been transferred, are fed via the switching gate apparatus 7 to the inversion unit 15, and then transported by the double-face invertor apparatus 16 to the transport path member 12 in the inverted position for a double-face copy. It should be noted that in the above described image forming apparatus, when the normal single-face copy mode is set, the copy paper sheets supplied from the paper supply tray are transported from the paper supply path 14 via the image transfer unit 2 to the fixing apparatus, and after the image is fixed thereon, the resultant copy paper sheets are fed toward the ejection tray 19. It is also possible to select a copy mode such that when single-face copy sheet is ejected to the ejection tray 19, the copy paper sheet is inverted. Furthermore, when a copy is formed by using special type of paper which cannot be stored into the paper supply tray, or a small amount of paper, the copy paper sheets may be inserted into the copying machine from a hand-supply tray 18 in a similar manner to the conventional electrophotographic copying machine.

Treatment of Paper Jamming in Invert-Transport Path

In the image forming apparatus with the above-described arrangement, when the transportation of single-face copy paper sheets is stopped within the invert-transport path and thus a paper jam occurs, the following paper jam treatment (processing) operation may be performed. It should be understood that the following paper jam processing operation is realized by previously setting a jam treatment program to the control apparatus of the image forming apparatus, whereby various operations for moving copy paper sheets or forming images are performed in response to the position of the paper jam. As a result, it is possible to employ a means for sensing copy paper sheets which passe through a sensor arranged in the paper transport path and a mechanism for sensing the occurrence of paper jam within the paper transport path based upon the information received about paper sheet passing time. Since the operations are monitored by way of the jam treatment program, the first-face copying stage may be discriminated from the second-face copying stage. As illustrated in FIG. 1(*b*), various sensors S1 through S8, employed in the image forming apparatus 1, are connected to an interface 41 of a control apparatus 40. Under the control of the jam treatment program stored in a storage unit 42, a CPU 43 controls, via an output interface 44, a gate apparatus 7, drive sources for the image transfer apparatus, and various driving rollers in order to execute the paper jam processing operation.

Figure 2:
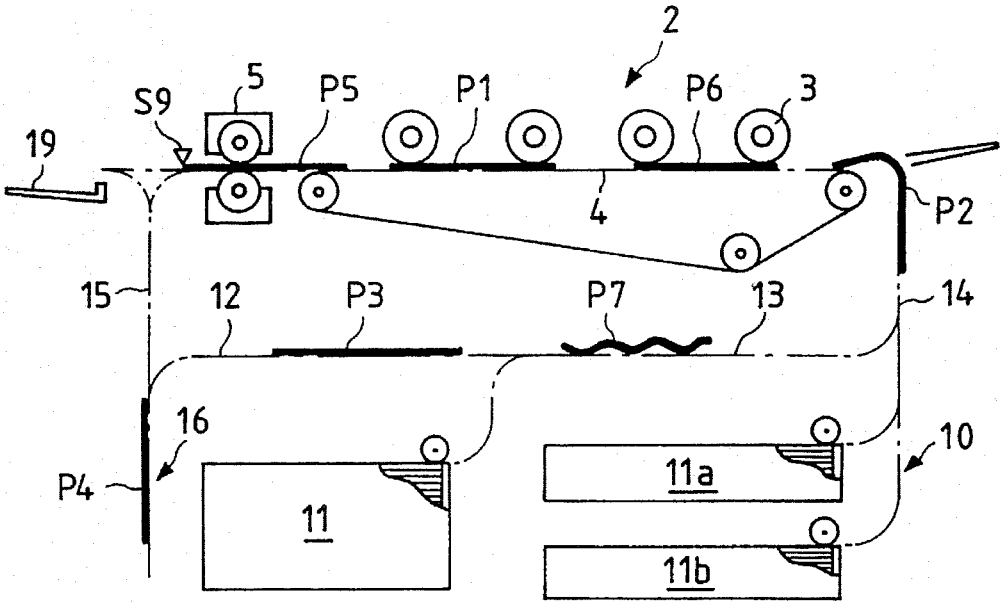
FIG. 2 is an explanatory diagram for showing a paper jamming condition at the registration transport unit employed in the copying machine of FIG. 1.
Figure 3:
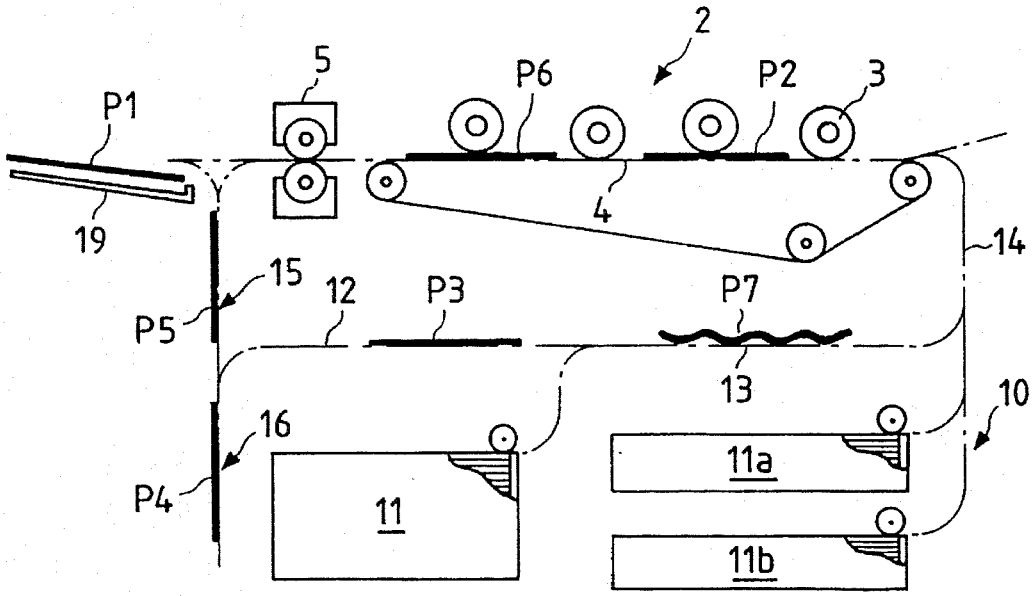
FIG. 3 is an explanatory diagram for representing a condition under which the paper jam of FIG. 2 is treated.

The paper jam treatment will now be described in detail:

a). As shown in FIG. 2, when a paper sheet P7 newly supplied from the paper supply tray is jammed within the register-transport unit 13 in the invert-transport path of the image forming apparatus 1, a condition is established such that six sheets of paper P1 to P6, can be transported under normal conditions within the paper transport path. As shown in FIG. 2, when the paper jam occurs within the register-transport unit 13, the paper sheet P5, to which the image has been transferred to its first face, is supplied to the inversion unit 15 which is capable of storing paper. The paper sheet P1 formed as a double-face copy is ejected to the ejection tray 19, as shown in FIG. 3. Among the paper sheets present in the image transfer unit 2, both the paper sheet P6, to which the image is being transferred to the first face thereof, and the paper sheet P2, which is waiting just before the image transfer unit, are stopped during the respective image transfer operations. It should be noted that both paper sheets P3 and P4, which are located up stream from the jammed paper sheet P7, cannot be further advanced, since they are held in a stopping state at respective waiting positions.

Figure 4:
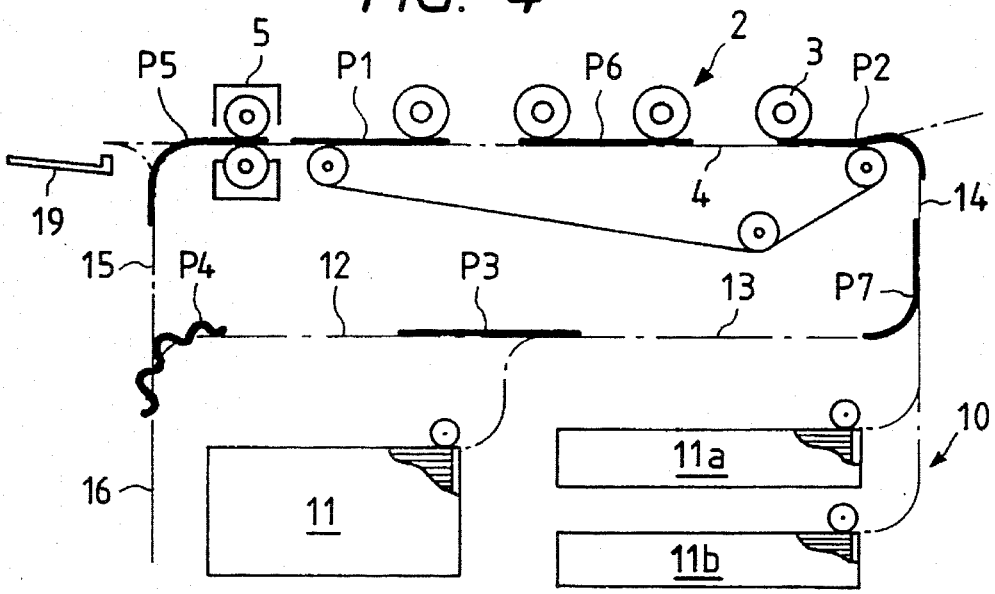
FIG. 4 is an explanatory diagram for indicating a condition under which a paper jam happens to occur at the entrance portion of the double-face copy transport path member of the copying machine.
Figure 5:
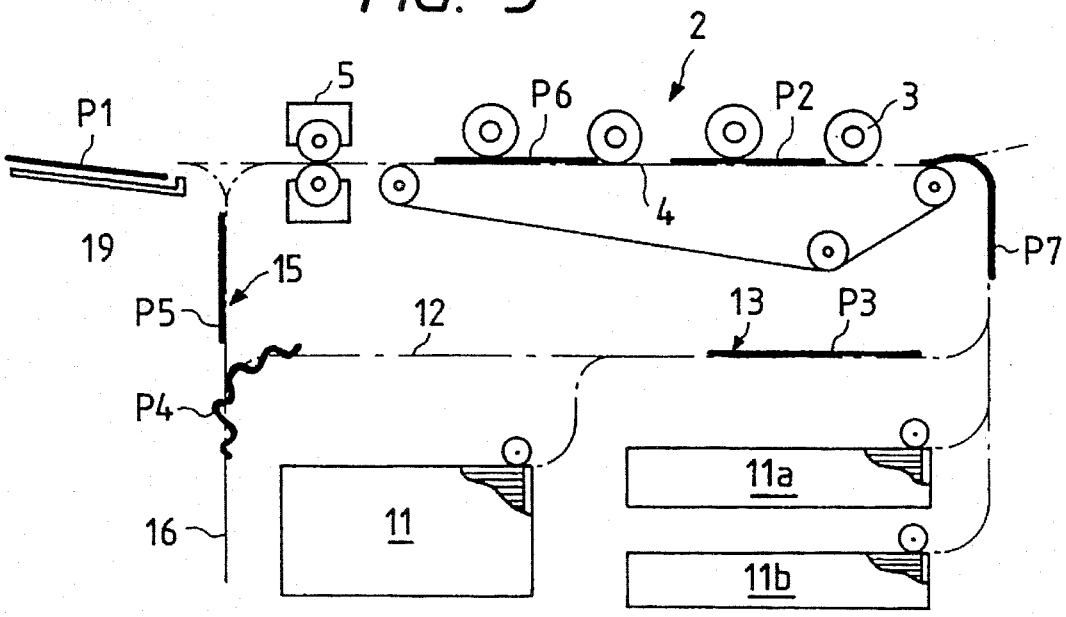
FIG. 5 is another explanatory diagram for showing a condition under which the paper jam of FIG. 4 is treated.
Figure 6:
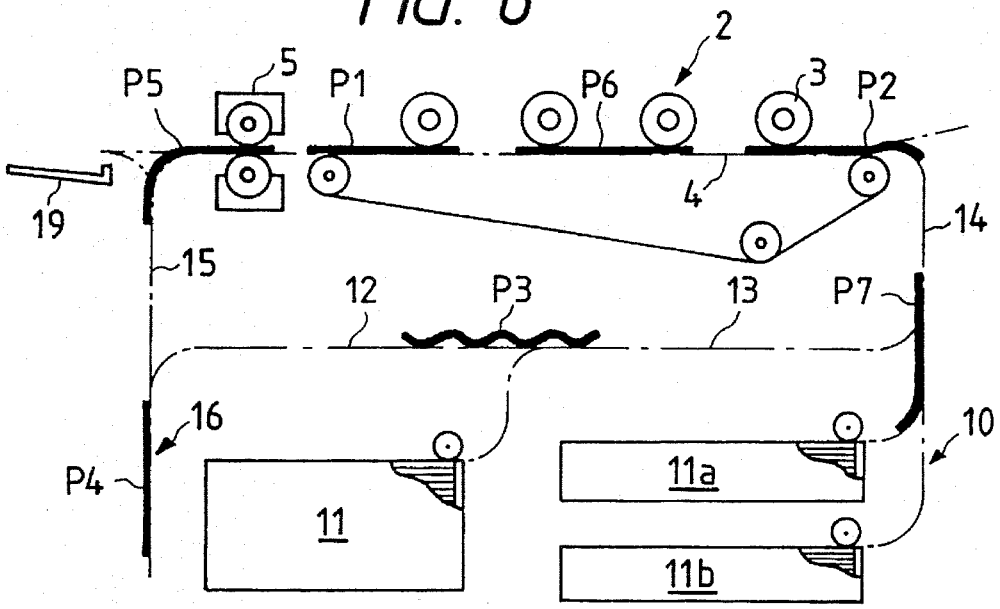
FIG. 6 is another explanatory diagram for indicating a condition that a paper jam occurs at the connection portion between the double-face transport path member and the registration transport unit employed in the copying machine.
Figure 7:
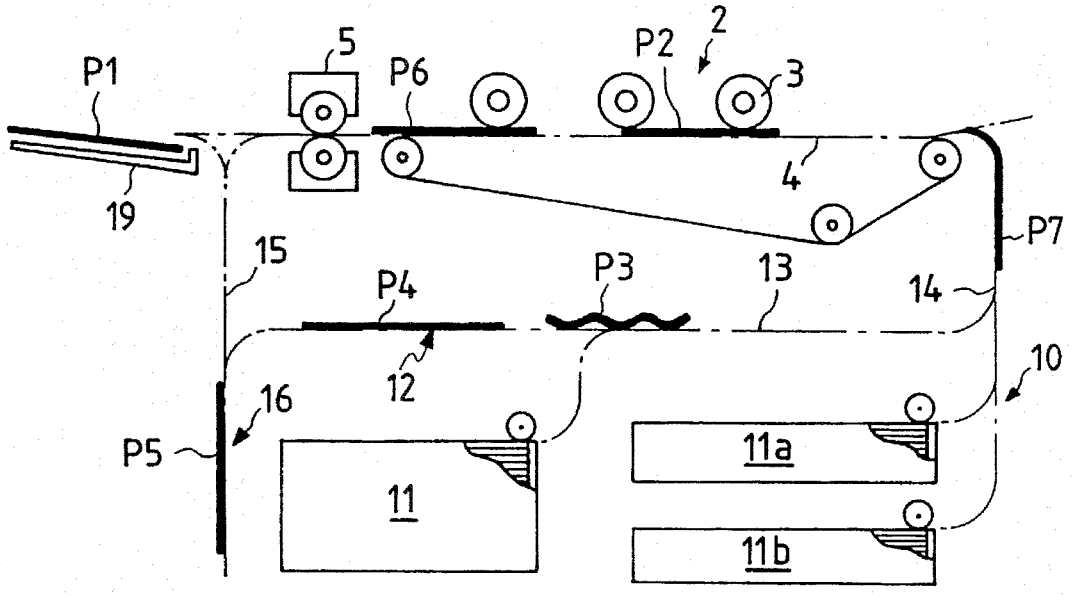
FIG. 7 is another explanatory diagram for indicating a halfway condition under which the paper jam of FIG. 6 is treated.
Figure 8:
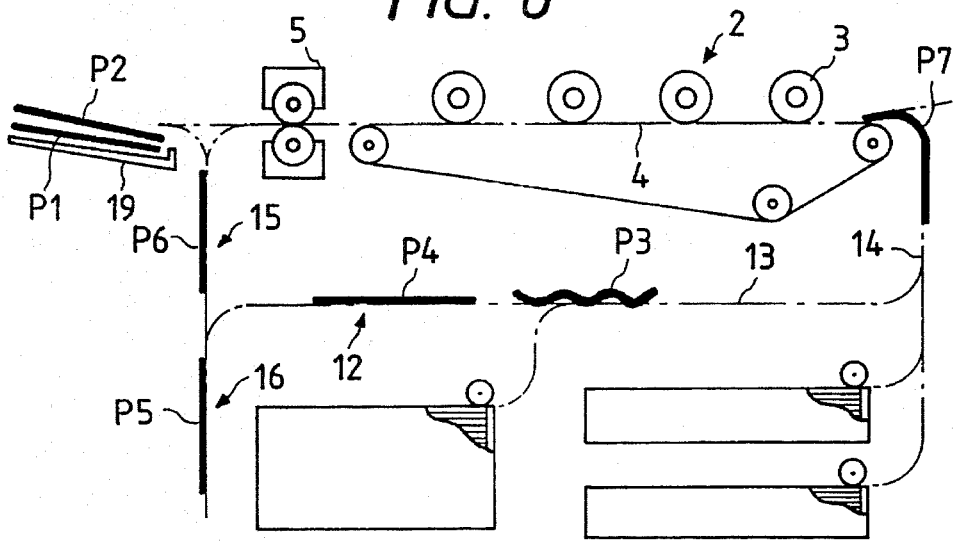
FIG. 8 is another explanatory diagram for representing a condition under which the jammed paper shown in FIG. 7 has been treated.

As previously explained, the paper treatment is carried out so that the copying operation can be easily restarted by removing the jammed paper sheet P7 from the paper transport path. In the case where the paper sheet P7, which is stopped at the register-transport unit 13, corresponds to the paper in which the second image is transferred, the image corresponding to this page should be transferred to a newly supplied paper sheet from the paper supply tray after the copying operation is restarted. However, the copying operation may be continued for the paper sheet stopped within the paper transport path while keeping the present copying mode.

b). As illustrated in FIG. 4, in the case where the paper sheet P4, which is transported from the double-face invertor 16 to the double-face copy transporting member 12 with an inversion condition, is jammed, a paper jam treatment, as represented in FIG. 5, may be performed. That is, the paper sheet P5 located in the fixing apparatus 5 is stored within the inversion unit 15, and the paper sheet P1 in which the image has been copied on both the first and second faces thereof, is ejected to the ejection tray 19. The paper sheet P5, which is located at the up stream side of the jammed paper sheet P4, is transported. On the other hand, a plurality of paper sheets located at the down stream side of the jammed paper sheet P4 are successively advanced by one step to respond to the corresponding image transfer and image positioning operations. Accordingly, only after the jammed paper sheet P4 has been removed can the normal copy formation be achieved.

c). A schematic diagram of the image forming apparatus according to the embodiment shown in FIG. 6 represents a condition where the jammed paper sheet P3 is stopped at a connection portion between the double-faced-copy transport path member 12 and the registration transport unit 13. When the paper transport is stopped under such a paper jamming condition, a process operation, as indicated in FIG. 8, can be performed subsequent to the process operation shown in FIG. 7. First, as shown in FIG. 7, the paper sheet P4, present in the double-face invertor apparatus 16, is transported toward the double-face-copy transport path member 12, and the paper sheet P5 under image fixing operation is moved toward the double-face invertor apparatus 16. At the same time, when the paper sheet P1, to which the image is being transferred to the second face thereof is a complete double-face copy, the double-face copy sheet P1 is delivered to the ejection tray, and the subsequent paper sheets P6, P2, P7 are advanced by one step. Next, as shown in FIG. 8, paper sheets P6 and P2, which are located in the image transfer unit 2, are formed as a single-face copy and a double-face copy respectively. While the paper sheet P7, which is under waiting condition, remains stopped at the register position, all of the paper sheets left in the image transfer unit 2 can be removed. Furthermore, the paper sheet P6, formed as the single-face copy, is stored in the inversion unit 15, under which condition, the image forming operation of the apparatus is interrupted, and an instruction requesting the operator to remove the jammed paper sheet is outputted.

As previously explained, when a paper sheet is jammed within the invert-transport path through which the single-face copy paper sheets are transported, a plurality of paper sheets located up stream from the jammed paper sheet can be sequentially advanced by one step. As for the paper sheets which can be formed as double-face copies and then ejected, the image transfer and fixing operations for the second face are carried out, and the double-face-copied paper sheets are ejected to the ejection tray. That is, after the above-explained copy forming and paper transporting operations have been executed, the copying operation of the image forming apparatus is stopped. Thereafter, an indication is made on a display unit, such as a control panel, that a paper jam has occurred, so that an instruction may be issued to an operator to remove the jammed paper sheet. It should be noted that the above-described embodiment represents the case where the double-face copies are formed with employment of small-sized copy paper. Similarly, in order for the treatment operations similar to the above operation stages a) to c) to be executed, when a double-face copy sheet is formed with respect to large-sized paper, a paper jam treating program for the image forming apparatus may be properly set.

In addition to the above-described arrangements, when a mechanism which is capable of simultaneously storing two sheets of paper is provided within the above-explained double-face invertor apparatus 16, the capability of storing single-face copy paper can be improved. For instance, when a nip roller is detachably provided with a drive roller member in a normal/reverse transporting roller apparatus arranged on the double-face invertor apparatus 16, the first stored paper sheet is stopped in such a manner that a tip portion of this paper sheet proceeds to a branch portion of the double-face-paper transport path member. The subsequently stored paper sheet is inserted under condition that the nip of the roller apparatus is released, and two sheets of paper are overlapped with each other having positional shifts, so that two sheets of paper can be stored at the same time. Thereafter, when the paper sheets are fed out from the double-face invertor apparatus toward the double-face-paper transport path member, the paper sheet which is stopped at the branch portion between the double-face-paper transport path member and the double-face invertor apparatus, is delivered first, and subsequently, the paper sheet stopped at the double-face invertor apparatus, is fed to the double-face-paper transport path member. To achieve the above-described control operations proper control information is required. When a purge tray is positioned just before the ejection tray in the above-described image forming apparatus, the paper sheets stored in the inversion unit 15, may be ejected with an inversion condition, and all of the paper sheets present down stream from the jammed paper sheet may be ejected from the image transfer unit to the image fixing apparatus.

Treatment of Paper Jamming in Copy Ejecting Unit

Figure 9:
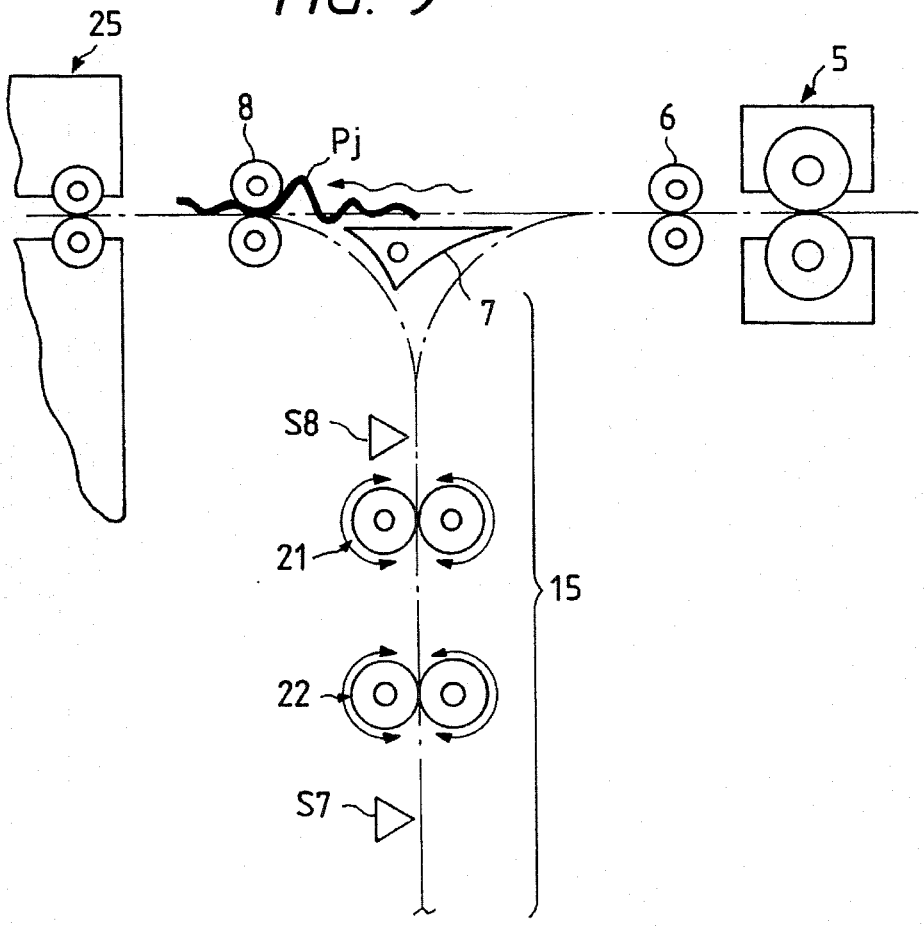
FIG. 9 is a further explanatory diagram for showing a condition under which a paper jam occurs in the ejecting roller portion of the copying machine.

In the image forming apparatus 1 shown in FIG. 1, a mechanism is constructed such that the switching gate apparatus 7 and the transport roller apparatuses 6, 8, which are located at both sides of the switching gate apparatus 7, are employed between the image fixing apparatus 5 and the copy ejecting (delivery) tray 19, whereby the single-face copy paper sheets are ejected while being inverted. The paper invert-ejecting mechanism is so arranged as shown in FIG. 9. That is, subsequent to the transport roller apparatus 6, and down stream from the image fixing apparatus 5, is the switching gate apparatus 7 which functions as a branch means and is combined with the ejection roller apparatus 8. A roller apparatus is arranged at the inversion unit 15 and is constructed as a normal/reverse rotatable roller apparatus. When an inverted copy sheet is ejected, paper sheets are transported via the gate apparatus 7 toward the inversion unit 15. Under the condition where all of the paper sheets have been stored in the inversion path, the switching gate apparatus 7 is switched, and the roller apparatuses 21 and 22 are driven along the reverse rotation direction. The paper sheets are transported via a guide surface of the switching gate apparatus 7 toward the ejection roller apparatus 8 and supplied to the ejection tray 19. Since the single-face copy paper sheets are deposited in the ejection tray such that the image plane formed on the paper sheets are directed to a lower direction when the single-face copy paper sheets are inverted and ejected, the sheets of the copy paper can be automatically sorted so that the subsequent copy handling operation may be readily performed.

FIG. 9 schematically shows a paper jam occurrence in the ejection roller apparatus 8 in the case where the paper sheet is directly ejected irrelevant of the invert-ejection mode. Under the condition where the switching gate apparatus 7 is provided up stream from the jammed paper sheet Pj and is swingable, the succeeding paper sheet is transported to the inversion unit 15, and a mode for temporarily storing this paper sheet with respect to the inversion unit 15 may be set. The operator removes the jammed paper sheet, inverts the paper delivered from the inversion path, and further rearranges the delivered paper sheets in the ejection tray, so that the image forming apparatus can be operated under normal conditions. In cases where the mechanism for ejecting the copy paper sheets to the purge tray is employed in correspondence with the switching gate apparatus 7, the succeeding paper sheets may be ejected toward the purge tray. Since the above-described jammed paper treatment is performed, the jammed paper treating operation can be easily carried out, as compared with a paper treatment in which the paper sheets are inverted and ejected from the inversion path.

Figure 10:
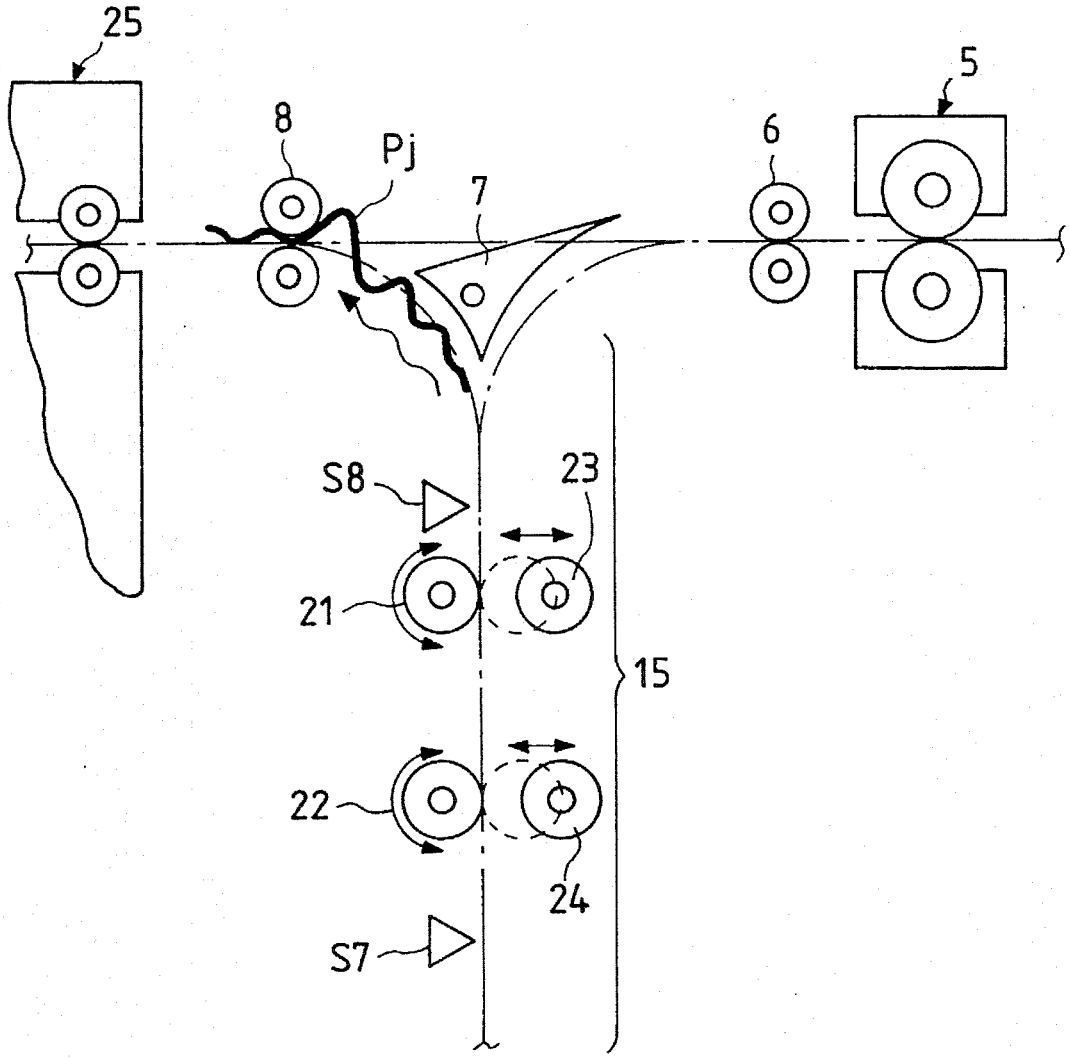
FIG. 10 is a further explanatory diagram for explaining a condition that when a paper jam occurs, it is intended to be ejected with inversion in the copying machine.

As illustrated in FIG. 10, a paper jamming state may be conceived such that a paper sheet being inverted and ejected is jammed. When this jammed paper sheet Pj is treated, easy operation of the image forming apparatus may be realized. That is, transport roller apparatuses 21 and 22 are arranged at the inversion unit 15 and are constructed of a drive roller member supported at a fixed position of the nip roller member and are capable of releasing the nip, and another drive roller member which is arranged to be drivable along the normal/reverse direction. For instance, in the transport roller apparatuses 21 and 22, there is provided a means capable of detachably connecting nip roller members 23 and 24 to the drive roller members. When the copy paper sheet is stopped, as jammed paper sheet Pj, under a condition that a tip portion of the single sheet of jammed copy paper Pj is nipped by the ejection roller 8, the nip roller member is separated from the drive roller member. Subsequent copy paper sheets are supplied via the switching gate apparatus 7, to the inversion unit 15, so that two sheets of paper are stored in the inversion unit 15 in such a manner that they are overlapped with each other, and the operation of the image forming apparatus is interrupted to instruct the operator to remove the jammed paper sheet.

Under the above-described condition, when the operator removes the jammed paper sheet Pj and depresses the set button of the control panel to restart the copying operation of the image forming apparatus, the nip roller members 23 and 24 are returned to the positions where they are in contact with the drive roller member, so that the temporarily stored paper sheets are delivered to the ejection tray. Subsequently, the image forming apparatus continues its operation of ejecting the inverted paper sheets in accordance with the normal copying mode. In the above-described embodiment, the transport path switching member arranged in the paper transport path has been described by using the switching gate 7. Alternatively, the transport switching member may be constructed by employing other transport path switching means used in electrophotographic copying machines and the like. Also, the jammed paper treating (removing) means applied to the invert-ejecting mechanism may be applied to other invert-ejecting mechanisms with employment of a tri-roll apparatus. Even when a paper jam occurs in the paper transport path within a sorter or a stacker, which is connected to the image forming apparatus, the present invention may be employed in order to treat the jammed copy paper sheet in the sorter or stacker. However, another process program, capable of properly executing such a jammed paper treatment so that the treatment of the jammed paper sheet can be carried out, should be employed.

In the paper transport apparatus of the image forming apparatus according to the present invention, since the above-explained jammed paper treating means is employed, a paper jam problem which occurs within the transport path in which the single-face copy paper sheets are transported to the second-plane copying stage, can be properly solved. In other words, when double-face copies are produced in which extremely large numbers of copy paper sheets are transported within the paper transport path at the same time, and a paper jam occurs in the invert-transport path, a plurality of single-face copy paper sheets are successively moved up stream from the paper jam, and are subsequently stopped. Further, since the copy paper sheets which can be ejected as double-face copies are ejected to the ejection tray, the copying operation can be restarted by removing only the jammed paper sheet, and the burden placed on the operator can be reduced. When a paper jam occurs in the paper invert-ejection path, the copy paper sheet located in the fixing apparatus is fed to the inversion path, and the problem of the succeeding copy paper sheets colliding with this jammed paper sheet can be avoided. The problem of a copy paper sheet being stopped within the image fixing apparatus can also be avoided.

What is claimed is:

1. An image forming apparatus comprising:

image transfer means for forming images on one or both of first and second faces of copy paper sheets;

a paper supply tray;

a first transport path leading to the image transfer means for alternately transporting blank copy paper sheets having no images formed on the first and second faces thereof and single-face copy paper sheets having an image formed on the first faces thereof;

a paper sheet inversion path connected to the first transport path beyond the image transfer means;

a copy sheet invertor apparatus connected to the paper sheet inversion path;

a second transport path connecting the copy sheet invertor apparatus to the first transport path to convey single-face copy paper sheets into the first transport path in alternation with blank copy paper sheets conveyed from the paper supply tray; and control means for controlling the image forming apparatus by performing a first operation and a second operation, the first operation being carried out in a manner such that, when a paper jam occurs, a single-face copy paper sheet located at the image transfer means is formed as a double face copy paper sheet by transferring an image from the image transfer means to the second face thereof and is then directed to the ejection tray, and the second operation being carried out in a manner such that a blank copy paper sheet to which an image has been transferred to the first face thereof by the image transfer means is sequentially advanced to a waiting position.

2. The image forming apparatus of claim 1, further comprising:

a copy ejection unit comprising first and second transport rollers, and a switching gate apparatus located between the first and second rollers at a junction of the first transport path and the paper sheet inversion path, wherein the paper sheet inversion path further includes third transport rollers, and the switching gate apparatus functions as a branch means, whereby, when a paper jam occurs and single-face copy paper sheets are stored in the paper sheet inversion path, the switching gate apparatus is switched to open a path to the ejection tray from the paper sheet inversion path and the third transport rollers of the paper sheet inversion path rotate to transport the single-face copy paper sheets to the ejection tray, and whereby when a paper jam occurs and double-face copy paper sheets are located at the first transport rollers, the switching gate apparatus is switched to open a path to the ejection tray from the first transport rollers, and the first and second transport rollers rotate to transport the double-face copy paper sheets to the ejection tray.

3. The image forming apparatus of claim 2, wherein both the paper sheet inversion path and the copy sheet invertor apparatus are capable of storing one single-face copy paper sheet under normal operating conditions of the image forming apparatus and are capable of storing a plurality of single-face copy paper sheets when a paper jam occurs in the image forming apparatus.

4. The image forming apparatus of claim 1, wherein both the paper sheet inversion path and the copy sheet invertor apparatus are capable of storing one single-face copy paper sheet under normal operating conditions of the image forming apparatus and are capable of storing a plurality of single-face copy paper sheets when a paper jam occurs in the image forming apparatus.

5. The image forming apparatus of claim 1, further comprising:

a transport path switching member coupled to the first transport path;

an ejection unit coupled to the ejection tray and the first transport path; and a transport roller apparatus for transporting copy paper sheets, wherein the paper sheet inversion path is coupled to the transport path switching member between the image transfer means and the ejection unit, and when a paper jam occurs on a down stream side of the transport path switching member, the transport roller apparatus transports copy paper sheets located on an up stream side of the paper jam to the paper sheet inversion path.

6. The image forming apparatus of claim 1, further comprising:

a transport roller apparatus having a nip, the transport roller apparatus being arranged in the paper sheet inversion path, wherein when a paper jam occurs in the first transport path adjacent the ejection tray, the nip of the transport roller apparatus is temporarily released, and two copy paper sheets on an up stream side of the paper jam are transported to the paper sheet inversion path for storage, with portions of the two copy paper sheets overlapping each other.

7. An image forming apparatus comprising:

image transfer means for forming images on one or both of first and second faces of copy paper sheets;

an ejection tray;

a paper supply tray;

a first transport path leading to the image transfer means for alternately transporting blank copy paper sheets having no images formed on the first and second faces thereof and single-face copy paper sheets having an image formed on the first faces thereof;

a paper sheet inversion path connected to the first transport path beyond the image transfer means;

a copy sheet invertor apparatus connected to the paper sheet inversion path;

a second transport path connecting the copy sheet invertor apparatus to the first transport path to convey single-face copy paper sheets into the first transport path in alternation with blank copy paper sheets conveyed from the paper supply tray; and a gate apparatus located in the first transport path between the ejection tray and the image transfer means and coupled to the paper sheet inversion path, the gate apparatus selectively separating copy paper sheets into the ejection tray and the paper sheet inversion path, whereby, when a paper jam occurs in the first transport path, any double-face copy paper sheets located in the first paper transport path down stream of the paper jam are directed by the gate apparatus into the ejection tray, and any single-face copy paper sheets located down stream of the paper jam are sequentially directed by the gate apparatus into the paper sheet inversion path.

8. The image forming apparatus of claim 7, wherein when a paper jam occurs in the first transport path, any blank copy paper sheets in the first transport path down stream from the paper jam are sequentially advanced to respective waiting positions.

* * * * *

UNITED STATES PATENT AND TRADEMARK OFFICE

CERTIFICATE OF CORRECTION

PATENT NO. : 5,532,793

DATED : July 02, 1996

INVENTOR(S) : Yoshio KOGURE it is certified that error appears in the above-indentified patent and that said Letters Patent is hereby corrected as shown below:

Claim 1, column 11, line 33, after "paper sheets;" insert --an ejection tray;--.

Signed and Sealed this

Nineteenth Day of November, 1996

*Attest:*

Bruce Lehman

BRUCE LEHMAN

*Attesting Officer*

*Commissioner of Patents and Trademarks*